United States Patent [19]

Vietorisz

[11] 4,171,798

[45] Oct. 23, 1979

[54] METHOD AND APPARATUS FOR OBTAINING AND SECURING OPTIMUM THRUST OF BLAST FLUID FLOWING INTO A METALLURGICAL FURNACE

[75] Inventor: Joseph A. Vietorisz, Pittsburgh, Pa.

[73] Assignee: Koppers Company, Inc., Pittsburgh, Pa.

[21] Appl. No.: 887,024

[22] Filed: Mar. 16, 1978

Related U.S. Application Data

[63] Continuation-in-part of Ser. No. 752,408, Dec. 20, 1976, abandoned, which is a continuation of Ser. No. 670,626, Mar. 26, 1976, abandoned.

[51] Int. Cl.[2] ..... C21B 7/16

[52] U.S. Cl. ..... 266/47; 266/266; 266/270

[58] Field of Search ..... 110/182.5; 122/6.6; 266/47, 197, 266, 270

[56] References Cited

U.S. PATENT DOCUMENTS

| | | | |
|---|---|---|---|
| 636,239 | 11/1899 | Benni | 122/6.6 X |
| 3,771,473 | 11/1973 | Borgnat et al. | 110/182.5 |

FOREIGN PATENT DOCUMENTS

| | | | |
|---|---|---|---|
| 400793 | 11/1933 | United Kingdom | 266/266 |

*Primary Examiner*—Roy Lake

*Assistant Examiner*—Paul A. Bell

*Attorney, Agent, or Firm*—R. Lawrence Sahr

[57] ABSTRACT

In a blast furnace tuyere, operating at subsonic velocity, an inner cylindrical air conduit is reduced to a frusto-conical conduit near the tuyere nose. A water cooled, pear-shaped, hollow body within the tuyere is held suspended by a bracket, in a centered position, where it exerts minimum interference with the pressurized fluid flowing partly through it and partly around it, having a cylindrical smaller conduit in such body and an annulus between the outer perimeter of such body and the inner wall of the cylindrical or conical conduit of the tuyere.

The bracket slides parallel to the tuyere axis in guides, which are integral parts of the tuyere proper, thereby securing a centered position whenever the bracket is approaching to or retreating from the tuyere nose. The area of the annulus is uniformly decreasing when the body on the bracket is moving toward the tuyere's nose; consequently, the air jet velocity through the tuyere is increased but, by virtue of the diverging-converging inverse annular nozzle between the frusto-conical conduit and the pear-shaped suspended body, a near parallel air current with optimum thrust can be maintained at any position of the body.

A driving mechanism serves to actuate the movement of the bracket and body; the driving mechanism being externally mounted at an accessible location.

5 Claims, 3 Drawing Figures

METHOD AND APPARATUS FOR OBTAINING AND SECURING OPTIMUM THRUST OF BLAST FLUID FLOWING INTO A METALLURGICAL FURNACE

CROSS-REFERENCE TO RELATED APPLICATIONS

This application is a continuation-in-part of application Ser. No. 752,408 filed Dec. 20, 1976, now abandoned which was a continuation of application Ser. No. 670,626 filed Mar. 26, 1976, now abandoned.

BACKGROUND OF THE INVENTION

One metallurgical furnace wherein blast air is used is a blast furnace. A blast furnace is kept in operation by blowing preheated air into it through a number of tuyeres. The air may be enriched with oxygen; also liquid or gaseous hydrocarbons, or pulverized coal may be added to the blast air as desired.

An elongated bubble-shaped space, called a raceway, exists in front of the nose of each tuyere. These raceways are diagramatically depicted in FIGS. 3 and 5 of United Kingdom Pat. No. 400,793. However, those skilled in the art will recognize that the raceways in a given furnace are not necessarily equal to each other in depth of penetration into the furnace nor in peripheral scope.

Combustion takes place in the raceways where the coke of the burden, and the additives, if used, which are introduced through the top of the furnace, burn to $CO_2$ and $H_2O$, which, in turn, are further reduced to CO and $H_2$. The CO and $H_2$ are then utilized as reducing agents to reduce the metallic materials of the burden.

It is generally recognized by those skilled in the art that the size of the raceways and their shape depend on the volume, pressure and temperature of the blast, as well as the cross-sectional size of the tuyere mouth. The degree of penetration of the blast into the burden in the furnace, namely, the length of the raceway from the tuyere mouth toward the center of the furnace, depends on three factors:

(1) the mass of the fluid passing through the tuyere;
(2) the flow velocity of the fluid jet leaving the tuyere mouth; and
(3) the magnitude of the thrust of the jet which is greatest whenever parallel flow of the fluid current is insured.

Blast fluid velocities also significantly affect the temperature distribution within the raceways. With increasing jet velocities, the region of highest temperature moves away from the tuyere nose and the temperature at the periphery of the raceways falls. The opposite effect can be observed when natural gas is used as an additive to the blast fluid. A result of unevenly distributed temperature in the raceways are erratic currents within the blast furnace which cause the burden to descend unevenly, thus disturbing stable furnace operations. This tendency toward uneven distribution of burden descent is enhanced by uneven or disproportionate tuyere operation, in relation to the other tuyeres within the blast furnace, which increases the incidence of erratic and undesirable currents.

Recent reports on blast fluid distribution among the tuyeres of large blast furnaces indicate that those tuyeres farthest from the blast fluid entrance into the manifold bustle pipe receive more mass of fluid than those nearer to the hot blast main entrance to the bustle pipe. The total blast is unevenly distributed among the tuyeres of equal mouth size cross-sectionally, resulting in the furnace working one-sidedly causing impaired production of pig iron.

Those skilled in the art will recognize that there are certain general steps that can be taken to obtain optimum production in large blast furnaces. First of all, good burden size is needed. Secondly, the top pressure can be increased to obtain additional production. Thirdly, oxygen enrichment can be added to further increase production. Fourthly, tuyere jet velocities should be maintained within narrow ranges relative to each other and they must be corrected for any change in blast conditions. Finally, deep penetration of the blast fluid jet into the burden should be insured.

Various means have heretofore been proposed to control the fluid flow both within the tuyere and as it leaves the tuyere mouth. It was suggested to employ transversally movable plates, cooperating with damper plates, for varying the inlet and outlet area of the tuyere. An outlet control similar to that suggested is disclosed in U.S. Pat. No. 296,225 wherein a water cooled gate is movable to block the flow of blast fluid to varying degrees depending on the position of the gate in relation to the tuyere mouth. Inserts have been suggested for placement inside the tuyere nose to reduce the cross-sectional area of the tuyere mouth, the insert being knocked out by a rod inserted through the peephole when it is desired to increase that area. Such a system is disclosed in U.S. Pat. No. 2,087,842. It has been proposed to provide an apparatus comprising a water-cooled ring disposed within and coaxially of a conical tuyere, the outside diameter of the ring being equal to the smallest internal diameter of the conical nozzle, the tuyere mouth. Such an apparatus is disclosed by U.S. Pat. No. 636,239. As mentioned, it has also been proposed to control the blast flow velocity as it leaves the tuyere mouth. Specifically, such a method is accomplished by deflection means extending beyond the tuyere mouth into the blast furnace hearth. Apparatus to effect this method is disclosed in United Kingdom Pat. No. 400,793. And, there is a "streamlined" body mentioned in the French Patent Letter No. 1,009,336, which body is a rigidly mounted vaporizer employed to add atomized water droplets to the blast fluid current; it is positioned inside of a tuyere, but it is not used for varying blast jet velocities.

U.S. Pat. No. 296,225 discloses various means of externally controlling a sliding stopper. The stopper functions by sliding transversally across the tuyere mouth similar to the operation of a gate valve. All of the external means for operating the stopper produce a transverse motion of the stopper which is opposed to the axis of the tuyere. The tuyere disclosed is of a special design, radically different from the tuyeres normally used in blast furnaces. This novel tuyere has an upper section which is out of the direct flow of the hot blast fluid, providing a convenient arrangement within and through which means to operate the stopper can be placed. However, this upper section provides an ideal means to create undesirable turbulance and unbalanced gas flow. There is no way disclosed or described by which the external operation means could be utilized in a cylindrical cross-section tuyere where no additional space is provided within the tuyere for the movement of the disclosed external operating means.

U.S. Pat. No. 636,239 discloses a hollow ring adapted to be displaced substantially axially within a tuyere until it fills the tuyere mouth and leaves only the central opening of the ring for the passage of the blast; then, by pulling the ring back, a varying amount of free space is left between the ring and the nozzle. As indicated by phantom outline in FIG. 1 of this patent, the ring drops below the longitudinal axis of the tuyere when withdrawn from the tuyere nose, resulting in an unbalanced gas flow.

United Kingdom Pat. No. 400,793 discloses, in item 6 of FIG. 6, a symetrical cylindrical body with a uniform wall thickness, the outer surface being coaxial with the bore. The walls are hollow, providing a coolant passageway. The specification of this patent states that the cylindrical body also takes the shape of a blast tuyere. The indication is that, in the shape of a blast tuyere, the cylindrical body would more closely resemble the preferred embodiment of the invention shown as item 1 in FIG. 1 therein; the positioning would be such that the smaller end of the blast tuyere shape would be directed away from the center of the blast furnace to enable the required deflection of the blast fluid in a manner similar to that shown in FIG. 4.

The manner in which the cylindrical body function is disclosed in United Kingdom Pat. No. 400,793 at page 2, lines 40 to 52 as follows:

> ". . . there is arranged in the tuyere of the shaft furnace, instead of the deflecting body, a perforated body which preferably has the shape of a smaller tuyere, in such manner that it may be wholly or partially inserted in the axial direction of the main tuyere, into the interior of the hearth. With such a shifting of the hollow insert body, a blast inlet position in the hearth and consequently the oxidation zone, is shifted during the working of the shaft furnace to any desired degree."

The specification further details the operation of the hollow insert at page 3, lines 3 to 11:

> ". . . the insert hollow body 6 is moved out of the tuyere 2 into the interior of the hearth by as much as the oxidation zones are to be moved forward. If the body 6 is fully drawn back into the tuyere 2, then the oxidation zone in front of the tuyere again receives that position which is given by the position of the tuyere itself."

United Kingdom Pat. No. 400,793 also teaches a most significant point at page 2, lines 90 to 94:

> "That the deflecting body should always be centrally arranged in the tuyere 2 is important as otherwise a tuyere current is produced which cannot be exactly controlled."

This language points out a critical deficiency found in the apparatus disclosed in U.S. Pat. No. 636,239.

Those skilled in the art are aware that modern tuyere arrangement design includes a horizontal blowpipe which carries the hot blast from the tuyere stock to the tuyere proper. The blowpipe has spherically machined ends that fit tightly into the machined end of the tuyere proper and the tuyere stock to give the arrangement a tight fit, even though the tuyere proper and the tuyere stock may be misaligned. The blowpipe is held in place by pressure from the tuyere stock which, in turn, is held tightly against one end of the blowpipe by a heavy spring and rod device called the bridle. The bridle is attached to the hearth jacket, through which the tuyere extends, and allows limited motion between and misalignment of the central axis of the tuyere stock, blowpipe and tuyere proper caused by inexact construction and by thermal movement of the furnace shell. The movement and misalignment so caused eliminates the ability to centrally position and arrange an insert within a tuyere proper, which insert is supported from means extending from the peep sight position on the tuyere stock as disclosed in both U.S. Pat. No. 636,239 and United Kingdom Pat. No. 400,793. Both of these patents include means disposed inside of and extending through the blowpipe to actuate the longitudinal travel of inserted bodies. Such arrangements interfere with the smooth supply of additives through the blowpipes; also, the need for replacement of the blowpipes and/or the tuyere causes difficulties in realignment.

The present invention employs actuators disposed fully outside the blowpipe and not extending therethrough, and the brackets holding the independent inserts are guided parallel to the tuyere's axis within the tuyere proper, securing thereby always a central position of the movable inserts. The principal objective of the present invention is to provide means for obtaining and securing optimum thrust for any given blast condition by achieving an exactly controllable concentric blast flow pattern simultaneously for a set of individual tuyeres. The principal objective being realized, it is possible to correct unstable working of the furnace, to equalize the uneven blast distribution, and to compensate for the changing blast conditions by enabling the furnace operator to set the tuyere jet velocities individually during furnace operation.

SUMMARY OF THE INVENTION

A tuyere, designed for operation at subsonic fluid velocity, has a cylindrical inner conduit that is reduced to a frusto-conical conduit near the tuyere nose. The inner conduit cooperates with an axially movable hollow pear-shaped body in such a way that the total flow area is uniformly diminishing when the body is moved toward the tuyere nose. The body is symmetrically positioned about the central axis of the tuyere, and it is held by a bracket means that is guided within the tuyere proper, parallel to the axis of the tuyere, to maintain the symmetry of the central axis of the tuyere with that of the body when the body is either moving or standing still regardless of misalignment and movement among the tuyere stock, blowpipe and tuyere proper. The body may be of a solid section and made of heat and corrosion resistant material, or it may be of hollow section and water cooled. Means are included to actuate the travel of the body inside, but not beyond the tuyere mouth, the bracket means being easily accessible from outside of the tuyere independent from the blowpipe. A cross section of the pear-shaped hollow body reveals an airfoil shape, similar to that of an airplane wing. This shape enhances parallel smooth flow of hot blast fluid through the hollow center and around the periphery of the body such that eddy currents are eliminated and, thus, erratic and uncontrollable turbulance, in the flow of hot blast fluids through the tuyere, are eliminated.

For a further understanding of the invention and for features and advantages thereof, reference may be made to the following description and drawings which illustrate a preferred embodiment of equipment, in accordance with the invention, which is suitable for practicing the method of the invention.

DETAILED DESCRIPTION

Figure 1:
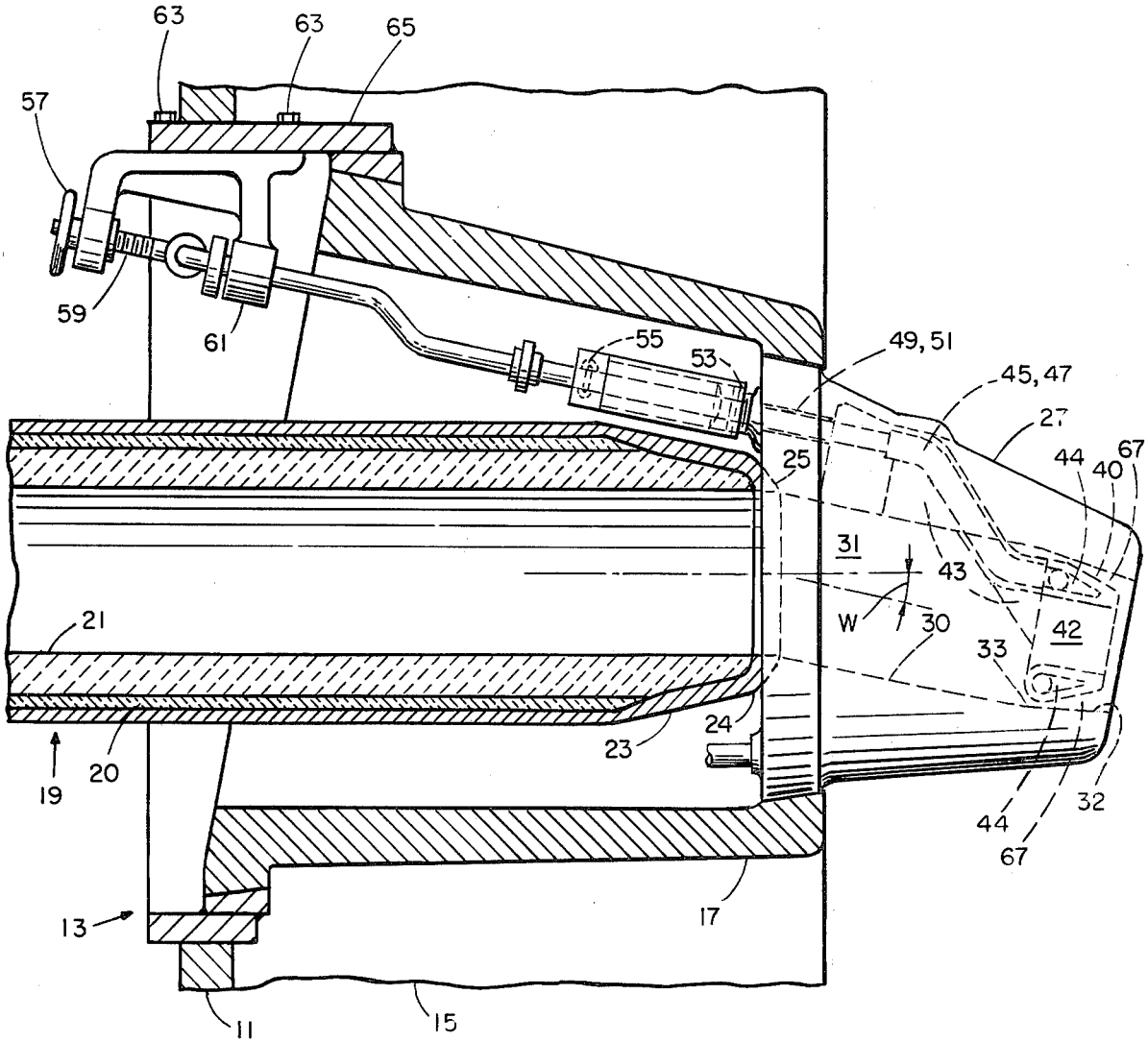
FIG. 1 is a schematic elevational view of the preferred embodiment of the apparatus in accordance with the invention.

Referring to FIG. 1, the shell 11 of a metallurgical furnace 13 is lined with refractory material 15 in a conventional manner and there are provided, around the periphery of the furnace, a number of openings exemplified by a tuyere holder 17 through both the shell 11, usually made of steel, and the refractory material 15.

Figure 2:
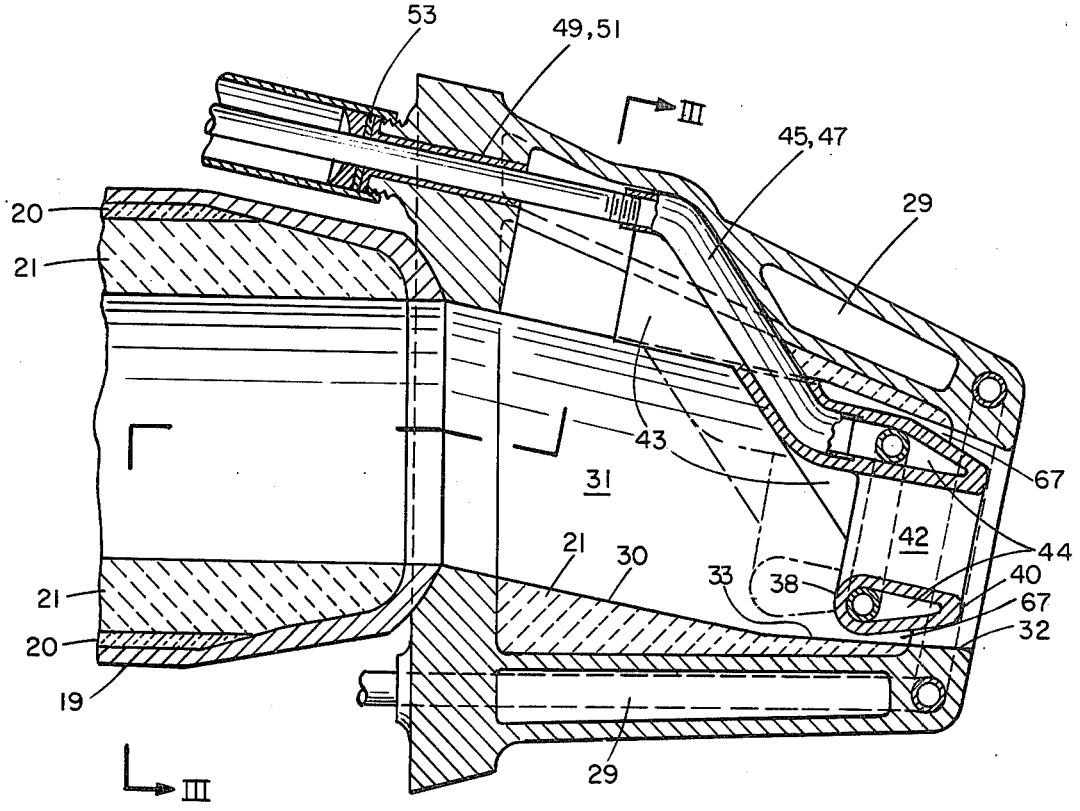
FIG. 2 is a view similar to that of FIG. 1 but of a vertical plane through the longitudinal centerline of the apparatus of FIG. 1.
Figure 3:
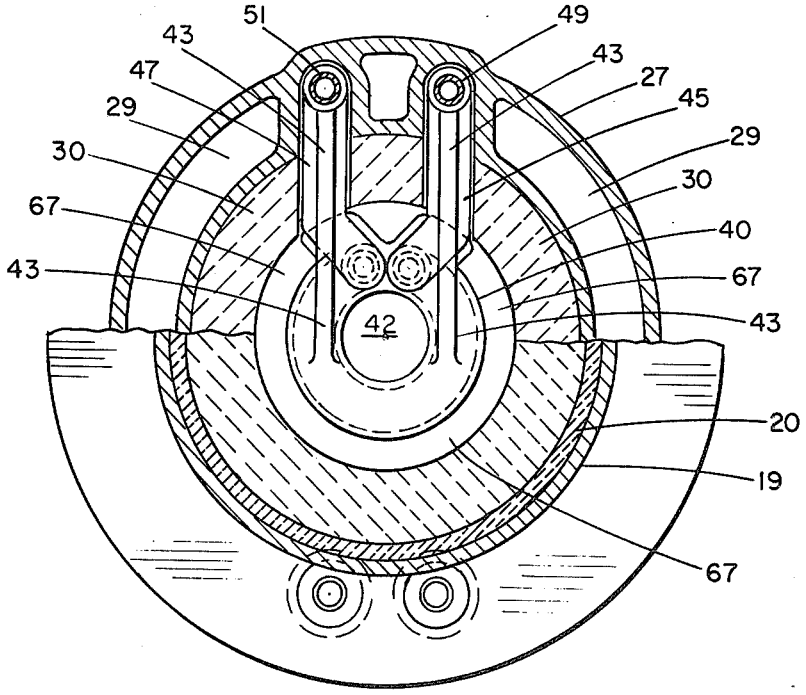
FIG. 3 is a view along line III—III of FIG. 2.

Referring to the drawings, FIGS. 1-3 illustrate the preferred embodiment of the present invention. In FIG. 1, a cylindrical blowpipe 19 is lined with suitable refractory material, as at 21, and has a convex, spherically tapering, generally frusto-conical end portion 23 ending in a convex spherical nose 24 that coacts with a concave spherical surface 25 of a tuyere 27. The blowpipe 19, in the embodiment of the invention shown in FIG. 1, is disposed horizontally. Between the steel blowpipe 19 and the refractory lining 21 therein, there is a layer of a suitable insulating material 20. The frusto-conical end portion 23 is also lined with the same suitable refractory material 21 which is shaped about as shown.

As will be noted in FIGS. 1 and 2, the tuyere 27 is disposed in a downwardly direction from the horizontal blowpipe 19 at an angle W. The tuyere 27 is provided with internal water channels 29 for cooling the tuyere body 27. The internal conduit 31 through the tuyere 27 is cylindrical shaped 30 part way, and then becomes frusto-conical, as at 33, near the tuyere mouth 32. Both the cylindrical shaped part 30 of the conduit 31 and the frusto-conical part 33 may be lined, respectively, with suitable refractory material 21. Alternately, the tuyere may be unlined to suit operating conditions.

Disposed movably within the frusto-conical passageway 33 is a generally frusto-conical tubular body 40. The frusto-conical tubular body 40 has a cylindrical axial central passage 42, and is provided with internal cooling water passages 44. The tubular body 40 is secured fixedly to brackets 43, as shown in FIGS. 1-3, and has a pear-shaped outer form. The tubular body 40 also may be considered as a body developed by revolving an airfoil-like area 38, similar to the cross-sectional shape of an airplane wing, about the common longitudinal axis of the tubular body 40 and the tuyere 27.

A pair of cooling fluid conduits 45, 47 are connected to the frusto-conical tubular body 40 in order to carry cooling water into and out of the cooling water passages 44. The exterior of these conduits 45, 47, as well as the brackets 43, are smooth and aerodynamically shaped to promote smooth blast fluid flow. It will be noted that the cooling fluid conduits 45, 47 are entirely independent of the blowpipe 19.

The cooling fluid conduits 45, 47 are movable in a linear direction, parallel to the axis of the internal conduit 31, inside the tuyere 27, and are guided by sleeves 49, 51 within the tuyere housing 27. A suitable gasket 53 and an O-ring 55 seal the conduits 45, 47 for preventing blast air leakage.

The frusto-conical body 40 is movable axially with respect to the tuyere 27 be means of a handwheel 57 and a threaded rod 59 which, when turned, moves the conduits 45, 47 as well as the body 40. The handwheel 57 and the threaded rod 59 are supported in a suitable stand 61 secured by means of suitable fasteners 63 to a supporting surface 65 mounted to the furnace shell 11.

It will be apparent to those skilled in the art that the handwheel 57 is shown only to illustrate one mechanism for moving the frusto-conical member 40. In any application of the invention, another suitable apparatus, located remotely from the furnace shell, may be employed. However, in any case, the other apparatus or the handwheel 57 and threaded rod 59 must be self-locking, which means that whenever the frusto-conical member is moved axially to a new position, it remains locked in such new position until the handwheel, or whatever other remote operating device is used, is actuated to move the frusto-conical member to a new position.

It will be noted from scrutiny of FIG. 2 that the frusto-conical body 40 is shown in a position toward the right of the view, toward the position of the tuyere mouth 32. This position of the frusto-conical body 40 is the furthest extent of its position toward the tuyere mouth. It will also be noted that, at the position depicted in FIG. 2, there is a gap or annulus 67 between the frusto-conical part 33 of the conduit 31 and the outer periphery of the frusto-conical body 40, the frusto-conical body 40 never coming into contact with the frusto-conical part 33 adjacent the tuyere mouth 30. This annulus 67 provides a peripheral channel which tends to guide the periphery of the blast fluid, hereinafter referred to as the peripheral portion, in a converging manner upon exit from the tuyere mouth. The balance of the hot blast fluid, hereinafter referred to as the central portion, is constricted through the central passage 42 of the frusto-conical body 40. Both the velocity of the peripheral portion of the blast fluid and that of the central portion of blast fluid, constricted through the central passage 42 of the frusto-conical body 40, are increased in proportion to the decrease in the cross-sectional area of the annulus 67. As the central portion meets the converging peripheral portion on exit from the tuyere mouth 32, the central portion tends to abate the convergence of the peripheral portion while the peripheral portion tends to abate divergence of the central portion. The result is a smooth parallel flow of balanced velocity hot blast fluid directed toward the center of the blast furnace hearth.

As the frusto-conical body 40 is moved away from the tuyere mouth 32 toward the left, as depicted in FIG. 2, shown in phantom, the effective cross-sectional area of the tuyere 27 is increased and the velocity of the hot blast fluid exiting from the tuyere mouth decreases.

When the frusto-conical body 40 is moved to a limiting position toward the left, the cross-sectional area of the annulus 67 is greatest. Likewise, when the frusto-conical body 40 is moved to a limiting position toward the right, toward the tuyere mouth 32, the cross-sectional area of the annulus 67 is least.

The hot blast fluid flow velocity is always subsonic and least in passage 42 and annulus 67 when the frusto-conical body 40 is at the limiting left-hand position, as viewed in phantom in FIG. 2. When the frusto-conical body 40 is at the limiting right-hand position, the hot blast fluid flow velocity in the annulus 67 and in passage 42 is greatest. Thus, as the frusto-conical body 40 moves from left to right, the total flow area of hot blast fluid gradually decreases, consequently the hot blast fluid jet velocity increases but remains subsonic.

Thus, in operating a metallurgical furnace equipped with tuyeres in accordance with the present invention, the velocity, as well as the degree of projection, of the hot blast fluid into the hearth of the furnace can be adjusted within desirable limits; the tuyeres have design characteristics that permit variation of the blast fluid velocity within preselected limits while maintaining an essentially parallel and smooth flow pattern for optimum thrust of the fluid jet by virtue of the integral guidance built into the tuyere proper, parallel to the tuyere axis.

From the foregoing description of the preferred embodiment of the invention, those skilled in the art should recognize important features and advantages therein, among which the following are particularly significant:

That the total flow of blast fluid through a tuyere in accordance with the present invention is variable due to the presence in the tuyere of a movable, axially positionable, frusto-conical member having a central cylindrical passage and a pear-shaped outer periphery which insures a deep penetration of the blast into the burden at any position of the moving body, even when blowpipe and tuyere axes are misaligned.

That the tendency for the blast fluid mass to vary with the distance the tuyere is from the entrance of the bustle pipe can be obviated since the velocity of the blast fluid in each tuyere of the present invention is adjustable and uniformity of the blast fluid mass flowing through all tuyeres is readily obtainable.

Those skilled in the art will recognize that the invention can be applied not only to blast furnace construction, but also to any process equipment that uses gaseous blast fluids in such quantities that a plurality of tuyeres are required and exact control of the blast jet velocities is desirable.

Although the invention has been described herein with a certain degree of particularity it is understood that the present disclosure has been made only as an example and that the scope of the invention is defined by what is hereinafter claimed.

What is claimed is:

1. In a metallurgical furnace, containing burden, into which hot blast fluid is introduced at multiple points, apparatus for obtaining and securing optimum thrust for any given condition of hot blast fluid at each of said multiple points, comprising:

(a) a plurality of blowpipes, one for each of said multiple points;

(b) a plurality of tuyeres, one each for each of said blowpipes, each of said tuyeres being abutted against and contiguous with a corresponding said blowpipe, each of said tuyeres including a frusto-conical nose interior, the mouth of each of said tuyeres which protrudes into said metallurgical furnace;

(c) for each of said tuyeres, a pear-shaped body, having a cylindrical axial passage through it, centrally disposed about the central axis of said tuyere, movable longitudinally along said central axis of said tuyere within, but not out of, said tuyere, a cross section of said pear-shaped body, extending from the outer periphery of said pear-shaped body to the periphery of said cylindrical axial passage, being an airfoil, the trailing edge of said airfoil being directed toward the interior of said metallurgical furnace; and (d) means, operable exteriorly of each of said tuyeres, but extending into each of said tuyeres, for guidedly moving and holding in position each of said pear-shaped bodies along said central axis of each of said tuyeres to which each of said pear-shaped bodies corresponds, concurrent with the flowing of said hot blast fluid through said tuyeres, said means being operable independent of the position of said tuyeres in respect to any other blast fluid flow part of said metallurgical furnace or equipment related thereto, said pear-shaped body being movable adjacent to but not in contact with said interior nose in such a manner that said hot blast fluid, exerting optimum thrust, flows around and through said pear-shaped body at subsonic velocity at all times during the flowing of said hot blast fluid, said velocity varying as each of said pear-shaped bodies is moved from one position to another within its said corresponding tuyere.

2. The invention described in claim 1 further comprising:

(a) means for liquid cooling each of said pear-shaped bodies; and wherein (b) the flow of hot blast fluid through and around each of said pear-shaped bodies merge in an essentially smooth parallel flow as said hot blast fluid exits each of said mouths of said corresponding tuyeres.

3. The invention described in claim 2 wherein:

(a) said means for liquid cooling each of said pear-shaped bodies includes a plurality of conduits carrying cooling fluid into and away from each of said pear-shaped bodies;

(b) at least one cavity within each of said pear-shaped bodies through which said cooling liquid is conducted; and (c) means for moving said conduits in conjunction with said means for moving and holding in position each of said pear-shaped bodies.

4. The method for obtaining and securing optimum thrust for any given conditions of blast fluid entering a metallurgical furnace at multiple points, comprising the steps of:

(a) flowing said hot blast fluid from a common source into a plurality of tuyeres, each of said tuyeres which correspond to one of said multiple points, said tuyeres which are directed into the interior of said metallurgical furnace;

(b) placing, into the nose of each of said tuyeres, one each of said noses which forms a portion of a corresponding said tuyere, each of said noses which protrudes into said metallurgical furnace, the interior of each of said noses which is frusto-conical in shape, a pear-shaped body having a cylindrical axial passage through it, centrally disposed about the central axis of said corresponding said tuyere, a cross section of each of said pear-shaped bodies, extending from the outer periphery of said each of said pear-shaped bodies to the periphery of its corresponding said cylindrical axial passage, forming an airfoil, the trailing edge of each of said airfoils being directed toward the interior of said metallurgical furnace; and (c) independently guidedly moving each of said pear-shaped bodies along each of said corresponding central axes of said tuyeres, adjacent said interior of each of said noses, but not out of said tuyeres, in such a way that independently moving, by means operable exteriorly from each of said tuyeres, but extending into each of said tuyeres, concurrent with said flowing of said hot blast fluid, said pear-shaped bodies along each of said corresponding central axes of said each of said tuyeres, adjacent said interiors of each of said corresponding said noses, but not out of said tuyeres, in such a way that said hot blast fluid flows around and through said pear-shaped body at subsonic velocity, said velocity being directly dependent upon the position of said pear-shaped body in relation to said interior of said nose, to produce an essentially smooth parallel flow of said hot blast fluid into said burden.

5. The invention of claim 4 including the step of flowing a cooling fluid into and out of said pear-shaped body.

* * * * *